US010171912B2

(12) United States Patent
Hanes

(10) Patent No.: US 10,171,912 B2
(45) Date of Patent: Jan. 1, 2019

(54) ANALOG DEVICE CONNECTION

(71) Applicant: Hewlett-Packard Development Company, L.P., Houston, TX (US)

(72) Inventor: David H Hanes, Loveland, CO (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/567,690

(22) PCT Filed: Jul. 29, 2015

(86) PCT No.: PCT/US2015/042724
§ 371 (c)(1),
(2) Date: Oct. 19, 2017

(87) PCT Pub. No.: WO2017/019069
PCT Pub. Date: Feb. 2, 2017

(65) Prior Publication Data
US 2018/0132040 A1 May 10, 2018

(51) Int. Cl.
*H04R 5/00* (2006.01)
*H04R 5/04* (2006.01)

(52) U.S. Cl.
CPC ..... *H04R 5/04* (2013.01); *H04R 2420/05* (2013.01)

(58) Field of Classification Search
CPC ..... H04R 5/00; H04R 5/04; H04R 2420/05
USPC ..... 381/55, 68, 77–82, 85
See application file for complete search history.

(56) References Cited

U.S. PATENT DOCUMENTS

| | | | | |
|---|---|---|---|---|
| 6,359,987 | B1 | 3/2002 | Tran et al. | |
| 6,870,934 | B2 | 3/2005 | Krochmal et al. | |
| 7,099,481 | B2 | 8/2006 | Baker et al. | |
| 8,594,815 | B2 | 11/2013 | Konetski et al. | |
| 9,906,860 | B2 * | 2/2018 | Tu | H04R 3/04 |
| 2010/0157172 | A1 * | 6/2010 | Chen | H04N 5/60 348/738 |
| 2011/0305349 | A1 * | 12/2011 | Asada | H04R 1/1041 381/74 |
| 2013/0058494 | A1 * | 3/2013 | Kim | H03G 3/301 381/74 |
| 2013/0259257 | A1 | 10/2013 | Larsen et al. | |
| 2013/0320993 | A1 | 12/2013 | Mehrabi | |
| 2014/0025845 | A1 | 1/2014 | Chadbourne et al. | |
| 2014/0112484 | A1 | 4/2014 | Britt | |

(Continued)

FOREIGN PATENT DOCUMENTS

KR 10-20140033916 3/2014

OTHER PUBLICATIONS

HP Pavilion a6658f Desktop PC, 2015, Available on the Internet at: http://www.manualshelf.com/manual/hp/hp-pavilion-a6658f-desktop-pc/getting-started-guide/page-86.html.

*Primary Examiner* — Disler Paul
(74) *Attorney, Agent, or Firm* — Wall & Tong LLP

(57) ABSTRACT

Examples associated with analog device connection are disclosed. One example includes a control device detecting an analog connection to an audio playback device. The control device transmits a first signal to the audio output device using the analog connection. The control device selectively enables a feature of the control device when a second signal is received by the control device from the audio output device using the analog connection. The second signal indicates the audio output device is an approved audio output device for the feature.

13 Claims, 6 Drawing Sheets

(56) References Cited

U.S. PATENT DOCUMENTS

| | | | | |
|---|---|---|---|---|
| 2014/0301562 | A1* | 10/2014 | Tu | H04R 3/00 381/74 |
| 2014/0307910 | A1 | 10/2014 | Howlett et al. | |
| 2016/0066077 | A1* | 3/2016 | Tu | H04R 29/001 381/74 |

* cited by examiner

ANALOG DEVICE CONNECTION

BACKGROUND

Consumers use speakers and headphones to listen to music and audio from other sources (e.g., videos, games, podcasts). Many of these audio devices include different types of connectors. One type of connection is an analog connection, which often uses a single cable between the audio device and a device controlling the audio device to, for example, play audio. Analog connections come in a variety of types including, for example, tip-sleeve connectors, tip-ring-sleeve connectors, tip-ring-ring-sleeve connectors, and so forth.

BRIEF DESCRIPTION OF THE DRAWINGS

The present application may be more fully appreciated in connection with the following detailed description taken in conjunction with the accompanying drawings, in which like reference characters refer to like parts throughout, and in which.

DETAILED DESCRIPTION

Systems, methods, and equivalents associated with analog device connection are described. Manufacturers of certain audio playback devices such as headphones and speakers may also produce devices that work together with these types of devices to provide additional functionality. These attached devices are generally referred to herein as control devices. In various examples, when an analog connection exists between a control device and an audio play back device, special measures may be taken to ensure that the two devices will act appropriately together.

These measures may include an "authentication" phase after an analog connection between a control device and an audio playback device has been detected. The authentication phase may involve passing signals between the audio playback device and the control device over the analog connection. These signals may be passed by toggling known resistance values across various components of the physical analog connector (sometimes referred to as a phone connector, a phone jack, an audio jack, and so forth). Once the control device is sure that the audio playback device is capable of performing the additional functionalities based on the communicated signals, the control device may activate these additional functionalities.

The "authentication" phase may also be desirable in other circumstances. By way of illustration, some manufacturers may prefer to prevent control devices from operating with unauthorized audio playback devices and/or to prevent certain audio playback devices from operating with unauthorized control devices. By authenticating whether the audio playback device is an approved device type using the known resistance values and/or other techniques for passing signals over the analog connection, the control device may be able to selectively prevent itself from working with unauthorized devices. This may allow the manufacturer of the control device to offer the control device for sale to users at a lower price by knowing that it will only operate with potentially more expensive types of audio playback devices.

In another example, by repetitively toggling resistance values, the audio playback device and the control device may be able to transmit information beyond a mere identification signal. This may allow, for example, instructions to be passed between the control device and the audio playback device. The instructions may allow, for example, the control device to update firmware and/or software of the audio playback device, or, for example, the audio playback device to tell the control device of desirable audio settings based on features of the audio playback device.

Figure 1:
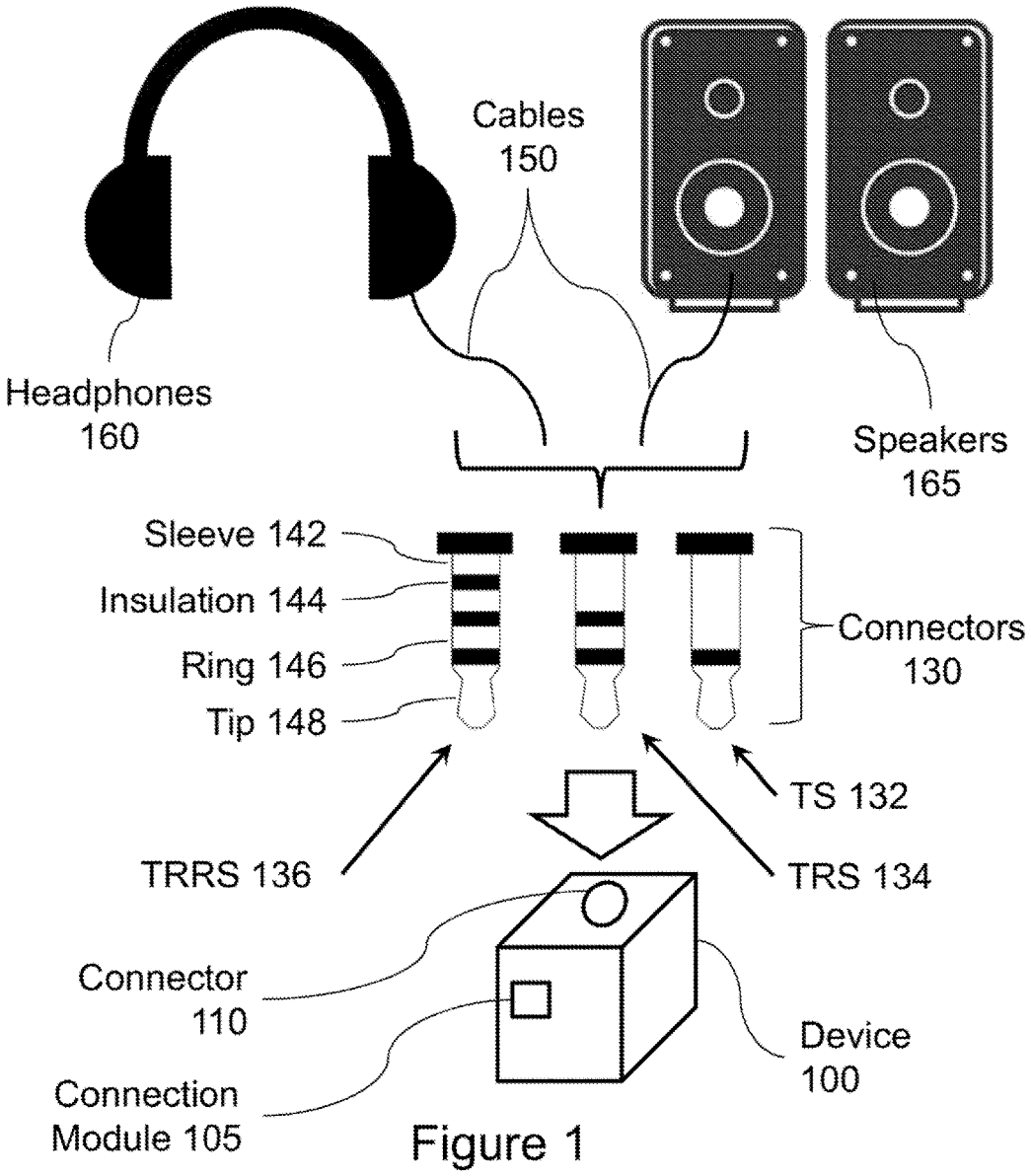
FIG. 1 illustrates an example device, and connectors with which example systems and methods, and equivalents, may operate.

FIG. 1 illustrates an example device and connectors with which example systems and methods, and equivalents, may operate. It should be appreciated that the items depicted in FIG. 1 are illustrative examples and many different, devices, connectors, and so forth may operate in accordance with various examples.

FIG. 1 illustrates an example device 100, connectors 130, and audio playback devices (e.g., headphones 160, speakers 165). Device 100 may be, for example, a control device that may perform various functions in association with various types of audio playback devices. For example, device 100 may contain a wireless internet connection to facilitate streaming content to be played via an audio playback device. Device 100 may perform a variety of other functions in addition to or instead of streaming content to an audio playback device.

Device 100 may connect to audio playback devices via an analog connection. In this example, device 100 is illustrated as having a female connector port 110 and the audio playback devices are illustrated as having cables 150 that attach to male connectors 130. In other examples, cables 150 may have male connectors on both ends, in which case the audio playback devices may include female connector ports similar to connector port 110. Other configurations of cables and connector port types may also be possible (e.g., where both the audio playback device and control device may have female connector ports which attach via a male-male connector cable.

Several different types of male analog connectors 130 are illustrated, including a tip-sleeve (TS) connector 132, a tip-ring-sleeve (TRS) connector 134, and a tip-ring-ring-sleeve (TRRS) connector 136. Sleeves 142, rings 146, and tips 148 may be separated by portions of insulation 144 to prevent audio channels from interfering with one another while the connectors 110 and 130 are in use.

The different types of connectors (e.g., TS, TRS, TRRS) may facilitate different features being available when delivering content from device 100 to the audio playback devices. For example, different contacts (e.g., tips, rings, sleeves) of connectors 130 may be associated with certain audio channels (e.g., left audio, right audio, ground, microphone). Consequently, when more contacts are available, more channels may be available to transmit content between device 100 and the audio playback devices.

Device 100 also includes a connection module 105. Connection module 105 may be designed to determine whether an audio playback device attached to device 100 is an approved device for a feature of device 100. An audio playback device may be considered an approved device for the feature of device 100 in a variety of circumstances. In some examples, the audio playback device maybe an approved device when it has some capability that device 100 can take advantage of. Put another way, the feature of device 100 may relate to a specific attribute of one or more of the audio playback device, device 100 and so forth. In other examples, the audio playback device may be an approved device when the audio playback device has been designated by the manufacturer of device 100 as a device with which device 100 is designed to operate. In some examples, this may related to a technological incompatibility, a business decision to prevent device 100 from operating with certain audio playback devices, and so forth. Consequently, if the audio playback device is not an approved device for the feature of device 100, then device 100 may refuse to operate in connection with the audio playback device.

To determine whether an audio playback device attached to device 100 is an approved device, connection module 105 may communicate with, for example, the audio playback device, a module or logic on the audio playback device, and so forth. This communication may be in the form of known resistance values being applied across various contacts of connectors 110 and 130. For example, after detecting an operable connection between device 100 and the pair of speakers 165, connection module 105 may cause device 100 to apply a 1.7 ohm resistance across the tip 148 and sleeve 142 of a connector 130 for a first millisecond after detecting the connection. When speakers 165 see the 1.7 ohm resistance, speakers 165 may apply a 2.7 ohm resistance across the tip 148 and sleeve 142 of connector 130 for the second millisecond after the connection is established. After seeing the 2.7 ohm resistance, connection module may accept that speakers 165 are an approved device and allow device 100 to activate a feature appropriate for speakers 165.

In other examples, information beyond a call and response may be exchanged between device 100 and audio playback devices. This may be achieved by repetitively toggling different resistance values across sleeves 142, rings 146, and tips 148 of a connector between device 100 and an audio playback devices. For example, in an example when a TRRS connector 136 is used, a first resistance value could be toggled across sleeve 142 and a first ring 146, a second resistance value could be toggled across the first ring 146 and a second ring 146, and a third resistance value could be toggled across the second ring 146 and tip 148. This may provide three different resistance values which device 100 and an audio playback device could treat as three different bits (e.g., 0's and 1's) which may facilitate encoding up to three bits of data. In other examples, different resistance values may be used to encode bits of data (e.g., 1 ohm, 2 ohms, 3 ohms . . . ).

Repetitively toggling resistance values may allow device 100 and audio playback devices to transmit data to one another. This data may, for example, describe specific makes and models of the audio playback device and/or device 100, specific features of the audio playback device and/or device 100, and so forth. In other examples, the data may include instructions. By way of illustration, an audio playback device may instruct device 100 as to a desired equalization setting. Alternatively, device 100 may be able to update software, firmware, and so forth within an audio playback device to enhance functionality of the audio playback device.

It is appreciated that, in the following description, numerous specific details are set forth to provide a thorough understanding of the examples. However, it is appreciated that the examples may be practiced without limitation to these specific details. In other instances, methods and structures may not be described in detail to avoid unnecessarily obscuring the description of the examples. Also, the examples may be used in combination with each other.

"Module", as used herein, includes but is not limited to hardware, firmware, software stored on a computer-readable medium or in execution on a machine, and/or combinations of each to perform a function(s) or an action(s), and/or to cause a function or action from another module, method, and/or system. A module may include a software controlled microprocessor, a discrete module, an analog circuit, a digital circuit, a programmed module device, a memory device containing instructions, and so on. Modules may include gates, combinations of gates, or other circuit components. Where multiple logical modules are described, it may be possible to incorporate the multiple logical modules into one physical module. Similarly, where a single logical module is described, it may be possible to distribute that single logical module between multiple physical modules.

Figure 2:
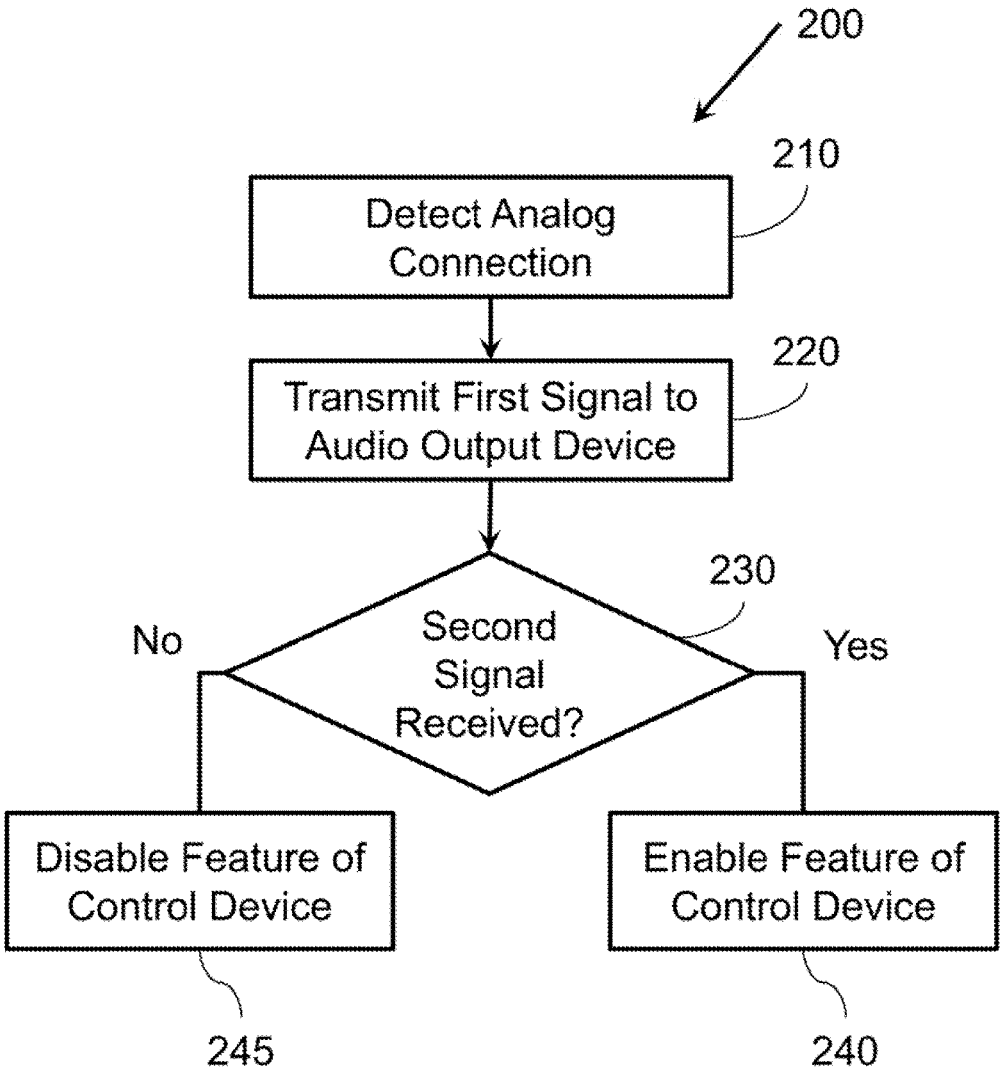
FIG. 2 illustrates a flowchart of example operations associated with analog device connection.

FIG. 2 illustrates an example method 200 associated with analog device connection. Method 200 may be embodied on a non-transitory computer-readable medium storing processor-executable instructions. The instructions, when executed by a processor, may cause the processor to perform method 200. In other examples, method 200 may exist within logic gates and/or RAM of an application specific integrated circuit (ASIC).

Method 200 includes detecting an analog connection at 210. A control device may perform the detection at 210. The connection may be detected between the control device and an audio output device. The audio output device may be, for example, a set of speakers, a pair of headphones, a headset, and so forth. In various examples, the analog connection between the control device and the audio output device may be achieved using different types of connectors. These connectors may include, for example, a tip-sleeve connector, a tip-ring-sleeve connector, a tip-ring-ring-sleeve connector, and so forth.

Method 200 also includes transmitting a first signal to the audio output device at 220. The first signal may be transmitted from the control device. The first signal may be transmitted using the analog connection. The first signal may be transmitted by applying a known resistance value for a predetermined time period across connectors of the analog connection. For example, the known resistance value may be applied across, for example, a tip and a sleeve, a tip and a ring, a ring and a sleeve, a ring and a ring, and so forth.

Method 200 also includes determining whether a second signal has been received at 230. The control device performs the determining action at 230. The second signal may be received from the audio output device using the analog connection. When a second signal is received at 230, method 200 may proceed to action 240 and enable a feature of the control device. Enabling or activating this feature may be appropriate when the second signal indicates that the audio output device is an approved audio device. If the second signal is not received at action 230, method 200 may proceed to action 245 and disable or not activate the feature of the control device.

Various features may be enabled or disabled. In some examples, entire functionality of the control device may be disabled or enabled if an appropriate signal is not received from the audio output device. This may essentially cause the control device to refuse to operate with, for example, unauthorized audio output devices. In other examples, the signal may indicate that the audio output device is capable of performing certain specialized actions, or that the audio output device has certain attributes (e.g., by conveying a model of the audio output device). In this example, the control device may activate a specialized feature to, for example, take advantage of the specialized actions, optimize audio output for the specific audio output device, and so forth.

Consequently, in combination, the determining action at 230, the enabling action at 240, and the disabling action at 245 may effectively form an action that selectively enables a feature of the control device depending on whether the control device receives a second signal that authenticates the audio output device over the analog connection. As discussed above, the authentication may serve to identify features of the audio output device that the control device may be able to take advantage of, to prove that the control device is allowed to operate with control device, and so forth.

Figure 3:
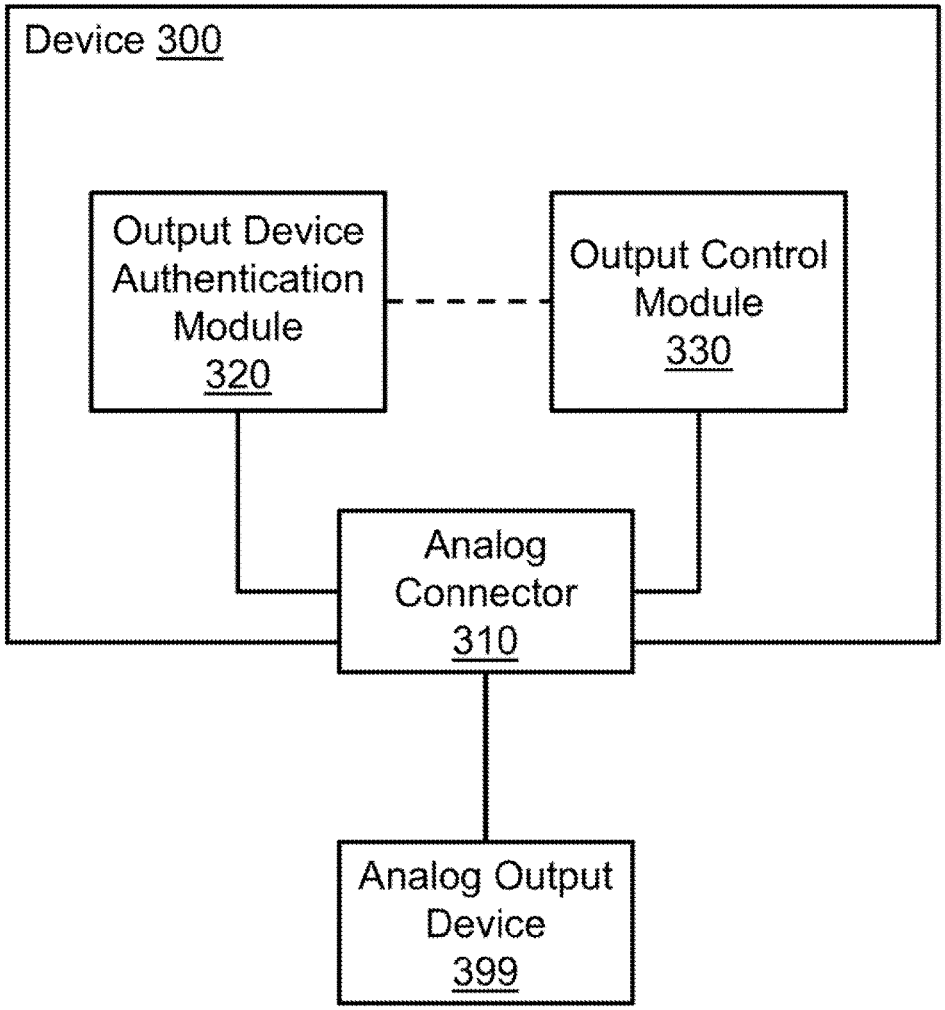
FIG. 3 illustrates an example device associated with analog device connection.

FIG. 3 illustrates a device 300 associated with analog device connection. Device 300 may be, for example, a network device, an audio/visual receiver, a computing device, and so forth. Device 300 includes an analog connector 310. Analog connector 310 connects device 300 to analog output device 399. Analog output device 399 may be, for example, a set of speakers, a pair of headphones, a headset, and so forth. In various examples, device 300 and analog output device may be independently powered. Analog connector 310 may be, for example, a tip-sleeve connector, a tip-ring-sleeve connector, a tip-ring-ring-sleeve connector, or another connector type.

Device 300 also includes an output device authentication module 320. Output device authentication module 320 may authenticate whether analog output device 399 is an approved output device. Output device authentication module 320 may authenticate analog output device 399 after detecting an operable connection between device 300 and analog output device 399. Output device authentication module 320 may authenticate whether analog output device 399 is an approved output device based on a series of signals passed between device 300 and analog output device 399 over analog connector 310. The series of signals may be generated by applying known resistance values across portions of analog connector 310 for predetermined time periods after a connection is established between device 300 and analog output device 399.

Device 300 also includes an output control module 330. Output control module 330 may selectively control analog output device 399 to perform a function based on whether analog output device 399 is an approved output device. In some examples, output control module 330 may control analog output device 399 based on a signal from output device authentication module 320. By way of illustration, after output device authentication module 320 authenticates analog output device 399, output device authentication module 320 may signal output control module 330 to perform the function.

Figure 4:
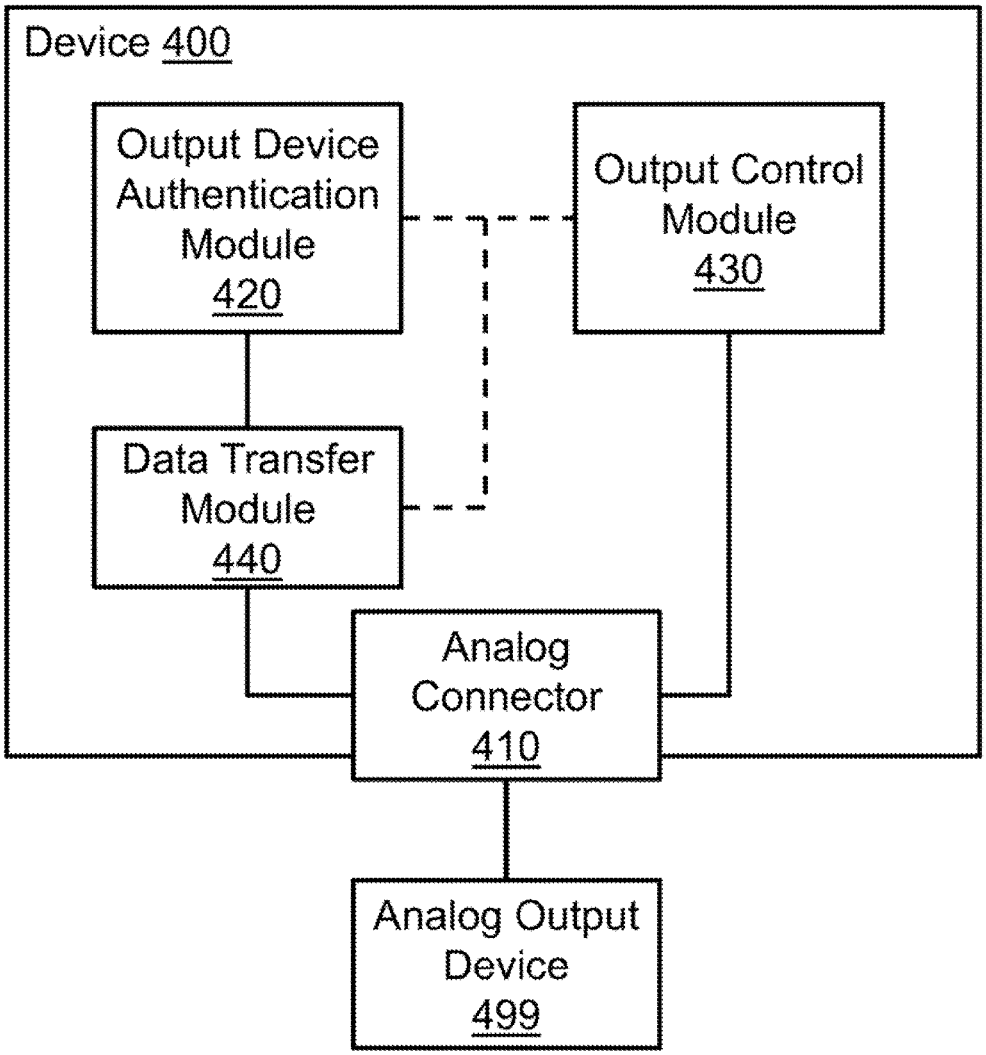
FIG. 4 illustrates another example device associated with analog device connection.

FIG. 4 illustrates another example device 400 associated with analog device connection. Device 400 includes several items similar to those described above with reference to device 300 (FIG. 3). For example, device 400 includes an analog connector 410 to connect device 400 to analog output device 499, an output device authentication module 420, and an output control module 430.

Device 400 also includes a data transfer module 440. Data transfer module may transfer data between device 400 and analog output device 499. Data may be transferred based on a repetitive toggling of known resistance values. The data transferred between device 400 and analog output device 499 may include, for example, a manufacturer of device 400, a manufacturer of analog output device 499, a model number of device 400, a model number of analog output device 499, features available to analog output device 499, attributes of analog output device 499, instructions for device 400, instructions for analog output device 499, and so forth. In some examples, a function of output control module 430 may also be controlled by data transfer module 440. By way of illustration, an instruction received from analog output device 499 for output control module 430 (e.g., an equalization setting) may be communicated to output control module 430 via data transfer module 440.

Figure 5:
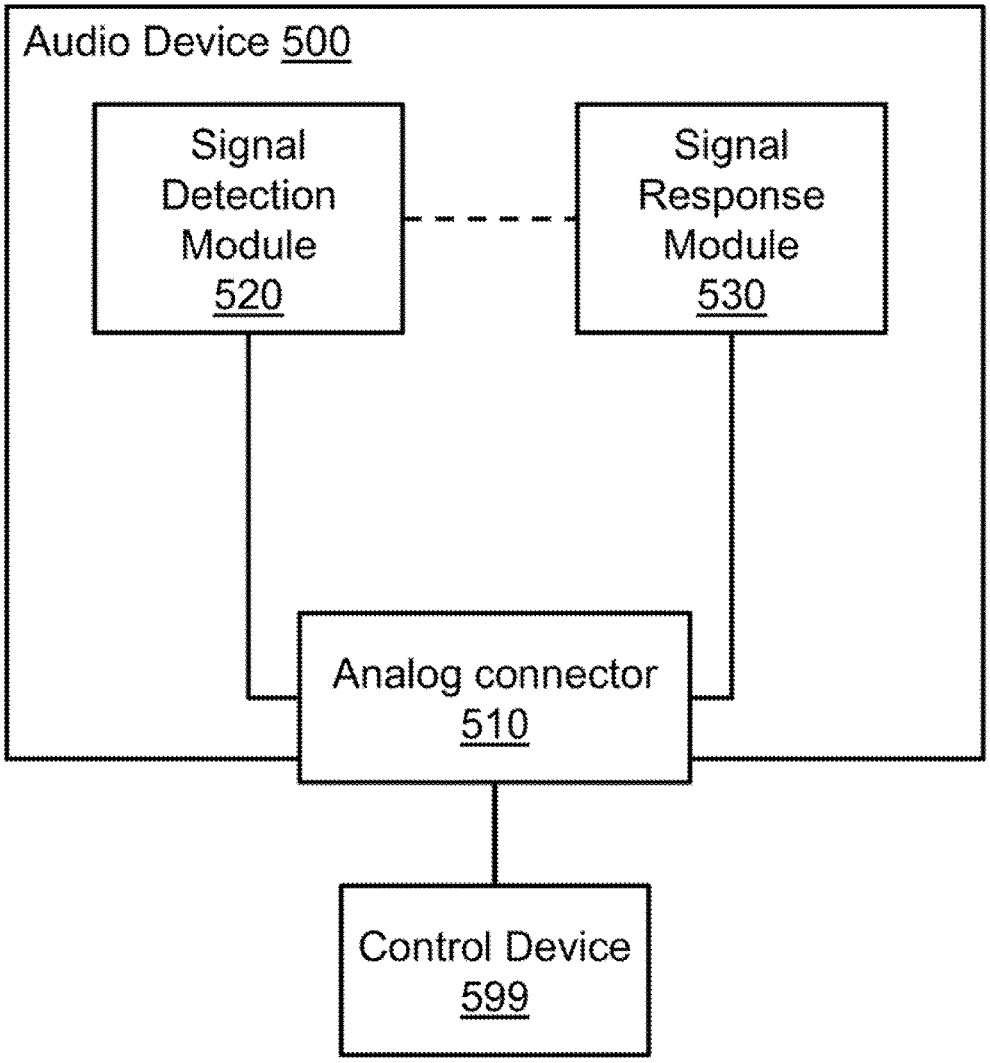
FIG. 5 illustrates another example device associated with analog device connection.

FIG. 5 illustrates an audio device 500 associated with analog device connection. Audio device 500 includes an analog connector 510. Analog connector 510 may connect audio device 500 to an analog connector associated with a control device 599. As discussed above, analog connector 510 may be, for example, a tip-sleeve connector, and so forth.

Audio device 500 also includes a signal detection module 520. Signal detection module 520 may sense a first predetermined resistance value across contacts of analog connector 510. In various examples, sensing the first predetermined resistance value may account for deviations of the first predetermined resistance value within a range of resistance values. By way of illustration if signal detection module 520 expects a resistance value of 1.7, signal detection module may accept as the 1.7 resistance value, a resistance value within a range around 1.7 to account for deviations stemming from variances in electronics or other sources.

Audio device 500 also includes a signal response module 530 to apply a second predetermined resistance value across contacts of analog connector 510. Applying the second predetermined resistance value may authenticate to control device 599 that audio device 500 is an approved device for a feature of control device 599. The feature of control device 599 may relate, for example, to sound quality of audio device 500.

Figure 6:
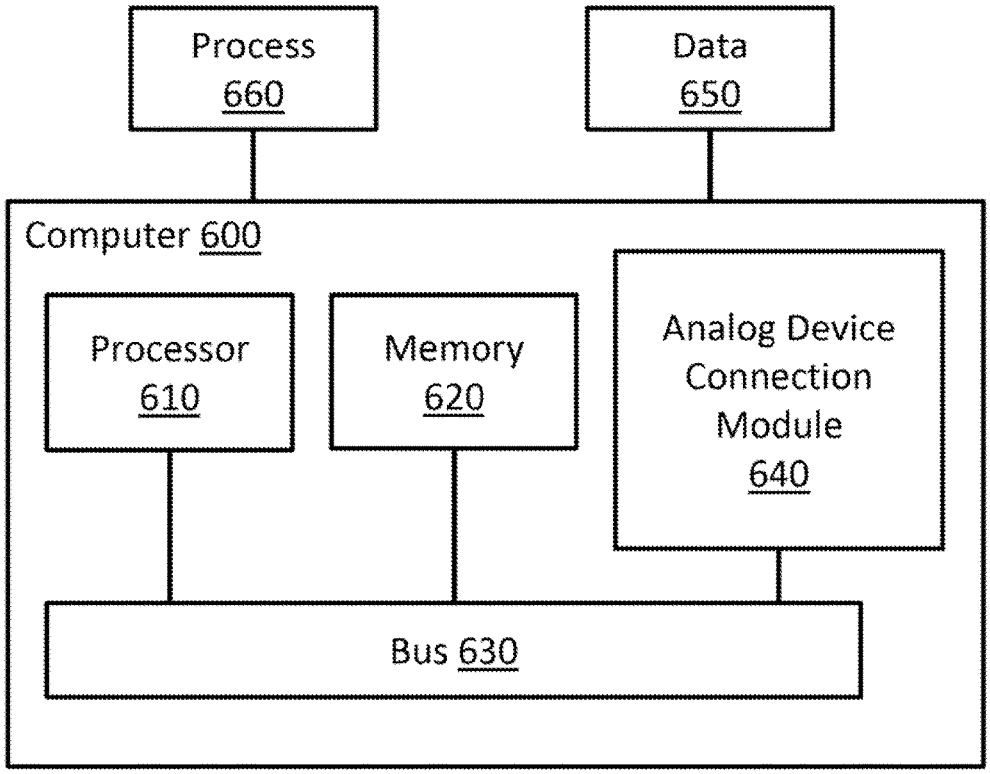
FIG. 6 illustrates an example computing device in which example systems, and methods, and equivalents, may operate.

FIG. 6 illustrates an example computing device in which example systems and methods, and equivalents, may operate. The example computing device may be a computer 600 that includes a processor 610 and a memory 620 connected by a bus 630. Computer 600 includes an analog device connection module 640. Analog device connection module 640 may perform, alone or in combination, various functions described above with reference to the example systems, methods, apparatuses, and so forth. In different examples, analog device connection module 640 may be implemented as a non-transitory computer-readable medium storing processor-executable instructions, in hardware, software, firmware, an application specific integrated circuit, and/or combinations thereof.

The instructions may also be presented to computer 600 as data 650 and/or process 660 that are temporarily stored in memory 620 and then executed by processor 610. The processor 610 may be a variety of processors including dual microprocessor and other multi-processor architectures. Memory 620 may include non-volatile memory (e.g., read only memory) and/or volatile memory (e.g., random access memory). Memory 620 may also be, for example, a magnetic disk drive, a solid state disk drive, a floppy disk drive, a tape drive, a flash memory card, an optical disk, and so on. Thus, memory 620 may store process 660 and/or data 650. Computer 600 may also be associated with other devices including other computers, peripherals, and so forth in numerous configurations (not shown).

It is appreciated that the previous description of the disclosed examples is provided to enable any person skilled in the art to make or use the present disclosure. Various modifications to these examples will be readily apparent to those skilled in the art, and the generic principles defined herein may be applied to other examples without departing from the spirit or scope of the disclosure. Thus, the present disclosure is not intended to be limited to the examples shown herein but is to be accorded the widest scope consistent with the principles and novel features disclosed herein.

What is claimed is:

1. A method, comprising:

detecting, in a control device, an analog connection to an audio output device;

transmitting a first signal from the control device to the audio output device using the analog connection, wherein the first signal comprises a first resistance value applied by the control device across the analog connection within a predetermined time period after the analog connection is detected; and selectively enabling a feature of the control device when a second signal is received by the control device from the audio output device using the analog connection, wherein the second signal comprises a second resistance value that is different from the first resistance value that is applied by the audio output device across the analog connection in response to the first signal, where the second signal indicates the audio output device is an approved audio output device for the feature.

2. The method of claim 1, where the audio output device is one of, a set of speakers, a headset, and a pair of headphones.

3. The method of claim 1, where the control device achieves the analog connection using one of a tip-sleeve connector, a tip-ring-sleeve connector, and a tip-ring-ring-sleeve connector.

4. The method of claim 1, where the feature is one of functionality of the control device and a specialized functionality of the control device.

5. A device, comprising:

an analog connector to connect the device to an analog output device;

an output device authentication module to, upon detecting a connection of the device to the analog output device, authenticate whether the analog output device is an approved output device based on a series of signals passed between the device and the analog output device over the analog connector, wherein the series of signals comprises a first resistance value applied by the device across the analog connector within a predetermined time period after the connection is detected and a second resistance value that is different from the first resistance value that is applied by the analog output device across the analog connector in response to the first signal; and an output control module to selectively control the analog output device to perform a function based on whether the analog output device is an approved output device.

6. The device of claim 5, comprising a data transfer module to transfer data between the device and the analog output device based on repetitive toggling of known resistance values.

7. The device of claim 6, where the data transferred includes at least one of, a manufacturer of the device, a manufacturer of the analog output device, a model number of the device, a model number of the analog output device, features available to the analog output device, attributes of the analog output device, instructions for the device, and instructions for the analog output device.

8. The device of claim 5, where the device is one of, a network device, an audio/visual receiver, and a computing device.

9. The device of claim 5, where the device and the analog output device are independently powered devices.

10. The device of claim 5, where the analog output device is one of a set of speakers, a headset, and a pair of headphones.

11. An audio device, comprising:

a male analog connector to connect to a female analog connector associated with a control device;

a signal detection module to sense a first predetermined resistance value applied by the control device across contacts of the male analog connector within a predetermined time period after detecting a connection between the male analog connector and the female analog connector; and a signal response module to apply a second predetermined resistance value across contacts of the male analog connector in response to the first predetermined resistance value that is sensed to authenticate to the control device that the audio device is an approved device for a feature of the control device.

12. The audio device of claim 11, where sensing the first predetermined resistance value accounts for deviations of the first predetermined resistance value within a range of resistance values.

13. The audio device of claim 11, where the feature of the control device relates to sound quality of the audio device.

* * * * *